US008584282B2

(12) United States Patent
Frondorf et al.

(10) Patent No.: US 8,584,282 B2
(45) Date of Patent: Nov. 19, 2013

(54) BOOST FEATURE FOR A BED

(75) Inventors: Michael M. Frondorf, Lakeside Park, KY (US); Mitchell A. Smith, Bellvue, WA (US); James R. Risk, Jr., Plover, WI (US)

(73) Assignee: Hill-Rom Services, Inc., Batesville, IN (US)

( * ) Notice: Subject to any disclaimer, the term of this patent is extended or adjusted under 35 U.S.C. 154(b) by 985 days.

(21) Appl. No.: 12/324,497

(22) Filed: Nov. 26, 2008

(65) Prior Publication Data

US 2010/0125952 A1 May 27, 2010

Related U.S. Application Data

(60) Provisional application No. 61/116,839, filed on Nov. 21, 2008.

(51) Int. Cl.
*A47B 7/02* (2006.01)

(52) U.S. Cl.
USPC ..... 5/618; 5/600; 5/616

(58) Field of Classification Search
USPC ..... 5/600, 613, 616, 618, 713, 617
See application file for complete search history.

(56) References Cited

U.S. PATENT DOCUMENTS

| | | | | |
|---|---|---|---|---|
| 3,465,373 | A * | 9/1969 | Wilson | 5/611 |
| 3,913,153 | A | 10/1975 | Adams | |
| 4,953,243 | A | 9/1990 | Birkmann | |
| 6,008,598 | A * | 12/1999 | Luff et al. | 318/16 |
| 6,378,152 | B1 | 4/2002 | Washburn et al. | |
| 6,396,224 | B1 | 5/2002 | Luff et al. | |
| 2004/0034936 | A1 | 2/2004 | Welling | |

FOREIGN PATENT DOCUMENTS

| | | | |
|---|---|---|---|
| DE | 20207648 | U1 | 8/2002 |
| EP | 0498111 | A2 | 8/1992 |
| EP | 1184026 | B1 | 6/2006 |
| WO | 02/17846 | A1 | 3/2002 |

OTHER PUBLICATIONS

TotalCare® Bed System User Manual USR042 REV 9 © 2007 by Hill-Rom Services, Inc.
TotalCare® Bed System and TotalCare® Duo® 2 System User Manual 147607 REV 1 © 2008 by Hill-Rom Services, Inc.
TotalCare® Bed System Quick Reference Guide DS176 REV 2/May 2007 © 2007 by Hill-Rom Services, Inc.
TotalCare® Caregiver Controls QD1721—Dec. 2002 United Kingdom Clinitron House, Ashby Park Ashby de la Zouch, Leicestershire LE65 1 JG, www.hill-rom.com.
VersaCare® Bed Quick Reference Guide DS142 REV 3/Apr. 2008 © 2008 by Hill-Rom Services, Inc.

(Continued)

*Primary Examiner* — Nicholas Polito
(74) *Attorney, Agent, or Firm* — Kenneth C. Baran

(57) ABSTRACT

An adjustable bed comprises an occupant support having adjustable settings that include an elevation, a profile and an angular orientation. The bed also includes an interface for allowing desired values of the adjustable settings to be individually commanded. The bed also includes a single-action boost control for commanding a boost configuration comprising a boost elevation setting and a boost profile setting and a boost angular orientation setting. The bed also includes an adjustment system for adjusting the bed to the desired values of the adjustable settings in response to inputs to the interface and for adjusting the elevation, profile and angular orientation to the boost configuration settings in response to input applied to the single-action boost control.

20 Claims, 14 Drawing Sheets

(56) References Cited

OTHER PUBLICATIONS

VersaCare® Bed User Manual USR119 REV 9 © 2008 by Hill-Rom Services, Inc.

Response to the Examiner's Preliminary Opinion for European Patent Application No. 09252583.1 entitled, "Boost Feature for a Bed" of Hill-Rom Services, Inc. Accompanying the response includes set of amended claims filed with the European Patent Office on Sep. 27, 2012.

European Search Report, "Application No. EP 09252583", (Feb. 16, 2012), The Hague. The Search Report is accompanied by the Examiner's Preliminary Opinion.

Communication Pursuant to Article 94(3) EPC from EPO; Dated Oct. 25, 2012; Application No. 09252583.1; Applicant—Hill-Rom Services, Inc.

Response to Communication Pursuant to Article 94(3) EPC; Dated May 3, 2013; Application No. 09252583.1; Applicant—Hill-Rom Services, Inc.

Communication Pursuant to Article 94(3) EPC from EPO; Dated May 28, 2013; Application No. 09252583.1; Applicant—Hill-Rom Services, Inc.

* cited by examiner

BOOST FEATURE FOR A BED

This application claims priority to U.S. Provisional Patent Application Ser. No. 61/116,839 entitled "Boost Feature for a Bed" filed on Nov. 21, 2008.

TECHNICAL FIELD

This application relates to an adjustable bed having a boost feature operable by a single-action boost control for placing the bed in a nonemergency state favorable for boosting a bed occupant away from the foot of the bed and toward the head of the bed.

BACKGROUND

Adjustable beds are used in hospitals and other health care settings. Such beds typically have an adjustable height, an adjustable profile, an adjustable angular orientation, an adjustable mattress firmness or some combination thereof.

Some of the adjustments made to the bed while occupied by an occupant can cause the occupant to migrate toward the foot of the bed. The need to reposition the migrated occupant adds to the workload of the caregiver staff. Moreover, the physical demands of repositioning the occupant can cause injury to the caregiver. Accordingly, it is desirable to provide a feature that helps caregivers reposition the bed occupant toward the head of the bed.

SUMMARY

An adjustable bed includes an occupant support having adjustable settings that include an elevation, a profile and an angular orientation and an interface for allowing desired values of the adjustable settings to be individually commanded. The bed also includes a single-action boost control for commanding a boost configuration comprising a boost elevation setting, a boost profile setting and a boost angular orientation setting. The bed also includes an adjustment system for adjusting the bed to the desired adjustable settings in response to inputs to the interface and for adjusting the elevation, profile and angular orientation to the boost configuration settings in response to input applied to the single-action boost control.

DETAILED DESCRIPTION

Figure 1:
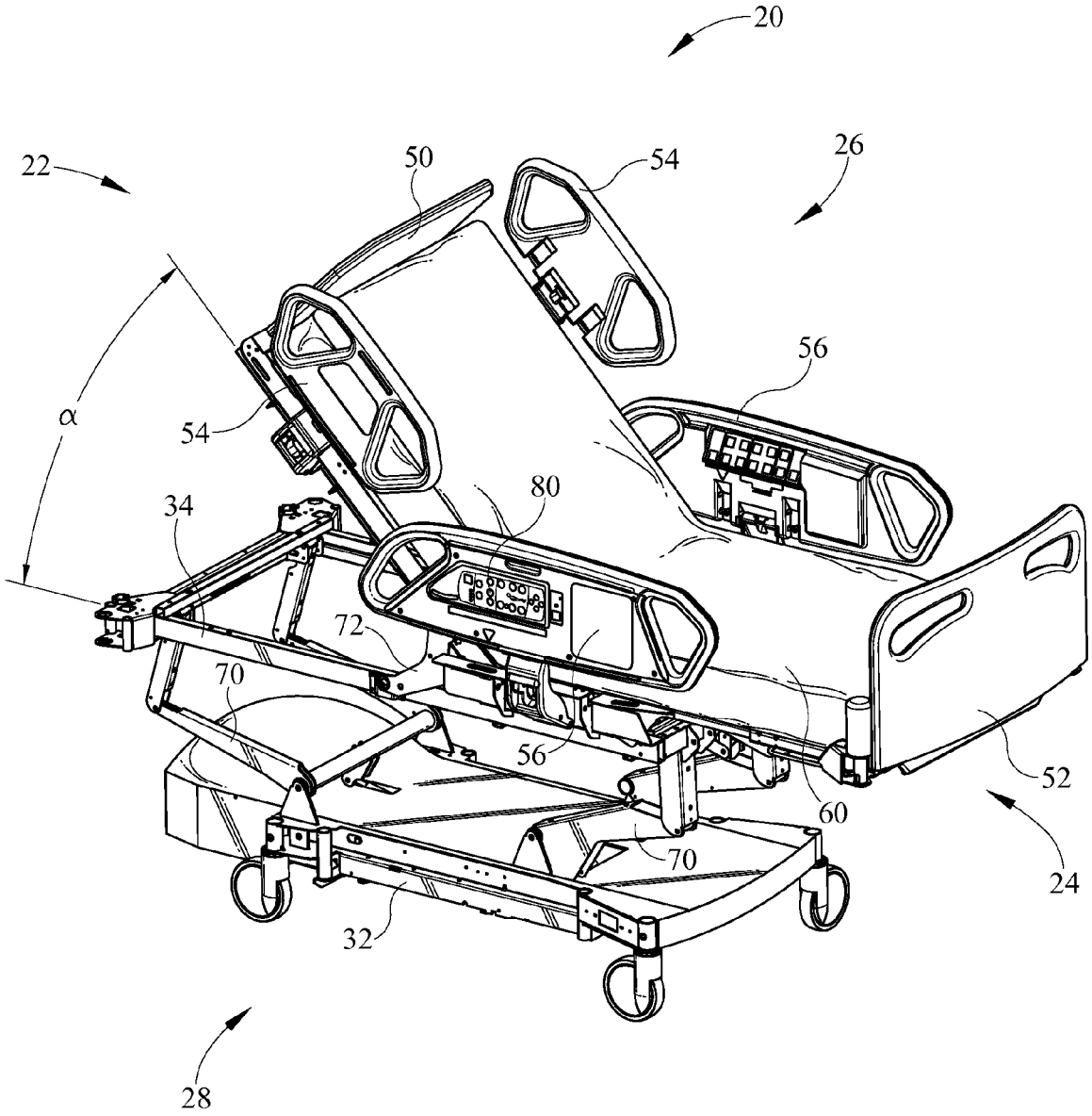
FIGS. 1-4 are perspective views of a bed described herein, the views showing the bed in various elevations, profiles and angular orientations.
Figure 2:
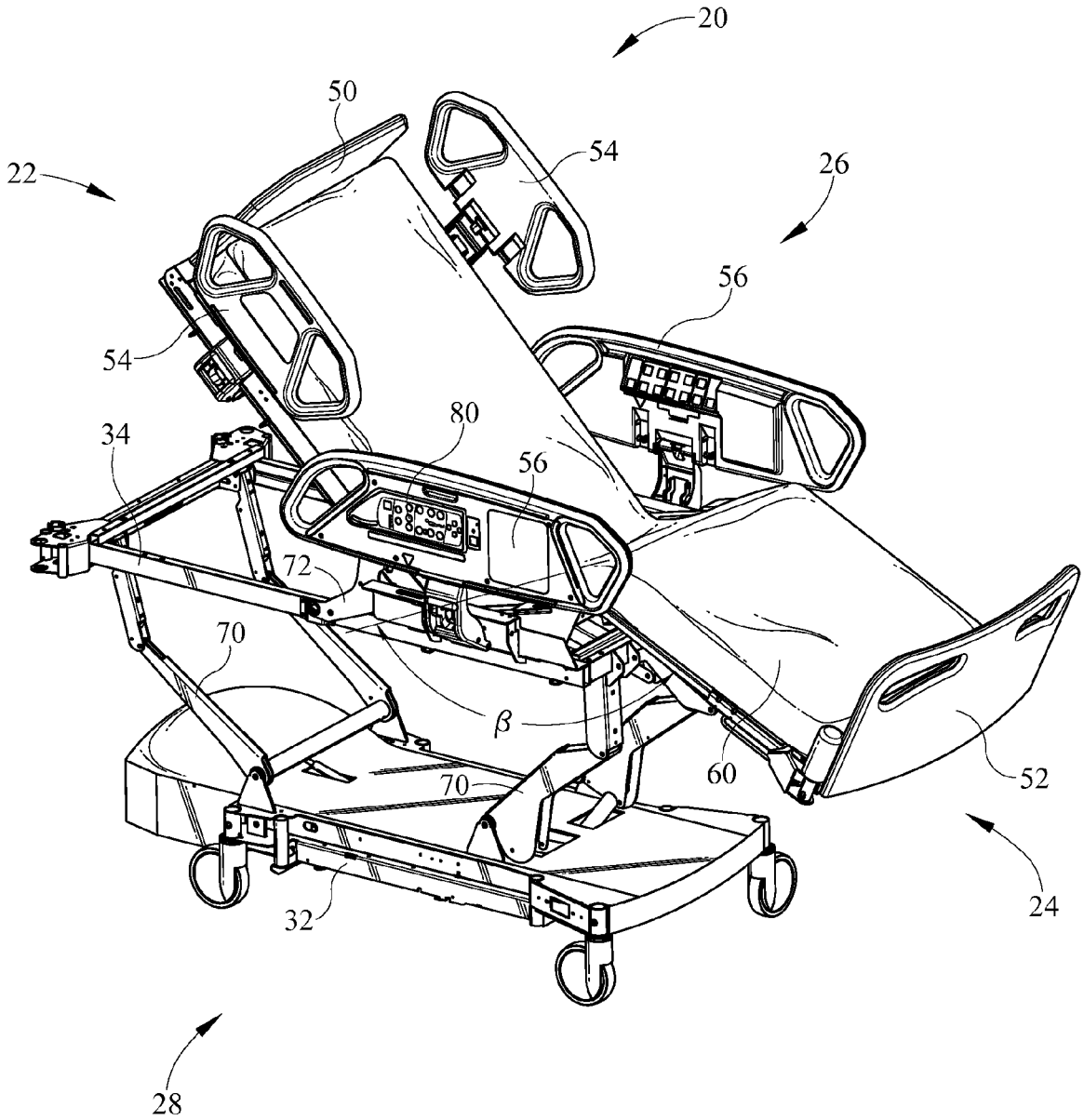
Figure 3:
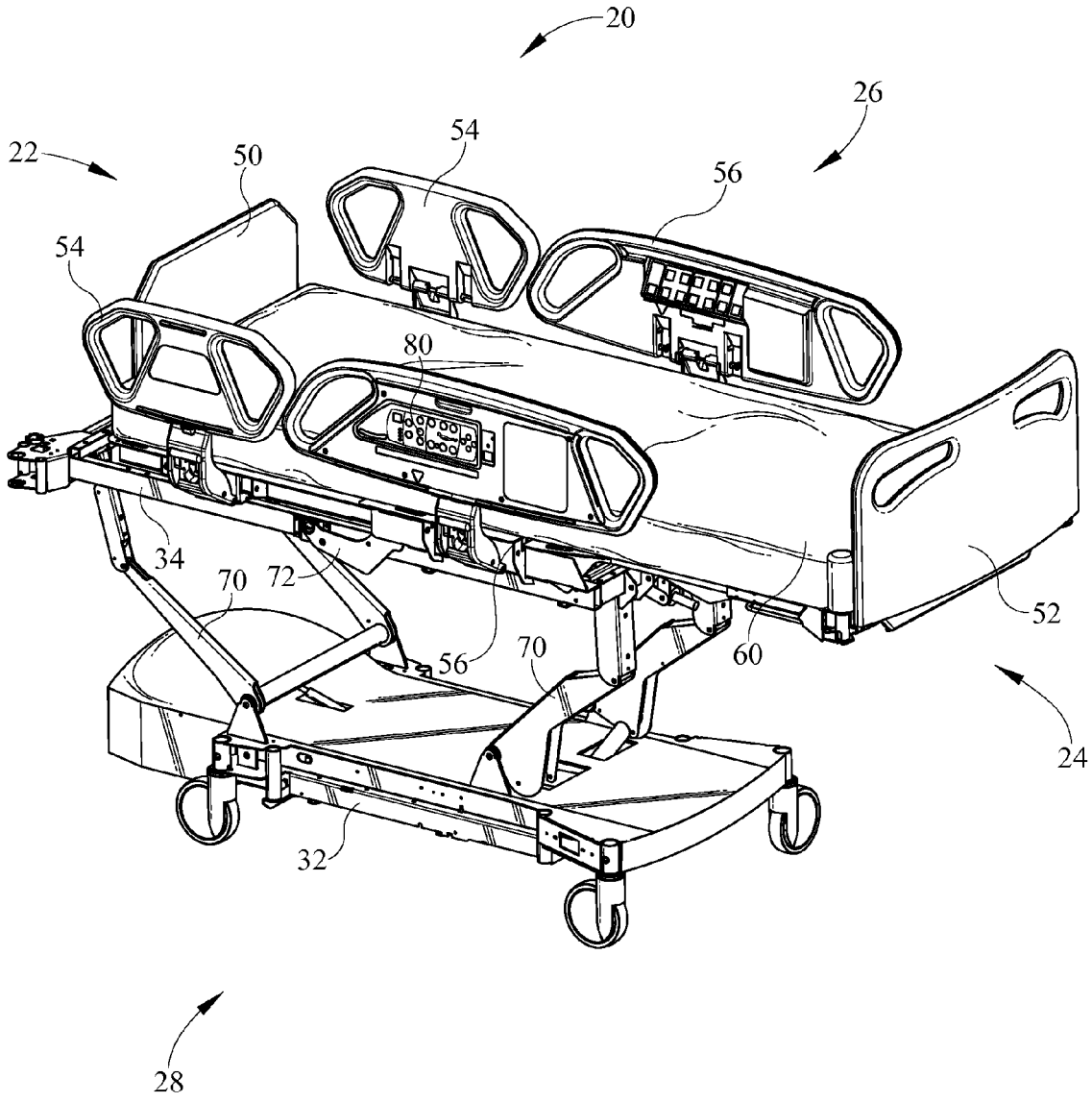

FIGS. 1-5 illustrate an adjustable bed 20 having a head end 22, a foot end 24 longitudinally spaced from the head end, a left side 26 and a right side 28 laterally spaced from the left side. The bed includes a base frame 32, an intermediate frame 34 and a deck 36. The deck of an adjustable bed typically comprises multiple sections such as upper body, thigh and calf sections 40, 42, and 44. The calf section includes a foot section extension 46 longitudinally positionable between a fully extended position and a fully retracted position. The extension can be placed in the fully retracted position to accommodate a short mattress length or may be partially or fully extended to accommodate a longer mattress length. The bed also includes a headboard 50, a footboard 52, head end siderails 54 and foot end siderails 56.

A mattress 60 rests on the deck. The mattress may be unsegmented or may be segmented into individual cushions. The mattress may be one with a non-adjustable firmness or one with an adjustable firmness. Adjustable firmness mattresses are typically inflatable mattresses that can be inflated or deflated by a compressor and/or aspirator 62 to an appropriate working firmness.

Collectively, the intermediate frame 34, the deck 36, and the mattress 60 comprise an occupant support 66.

Links 70 and intermediate frame actuators, not visible, moveably connect the intermediate frame to the base frame. Links 72 and deck actuators, also not visible, moveably connect at least some of the deck sections to the intermediate frame. The actual physical configuration, construction, quantity and arrangement of the frames, deck, links and actuators may differ from the configurations shown in the illustrations without affecting the applicability of the subject matter claimed herein. Collectively, the links and actuators comprise an adjustment system for adjusting various settings of the occupant support to desired settings. These settings include:

1) the elevation H of the intermediate frame as determined by the height of a reference datum R on the intermediate frame;
2) the angular orientation θ;
3) the deck profile, which can be substantially planar (FIGS. 3, 4) or can be non-planar (FIGS. 1, 2, 5); and
4) the foot section position F.

Using a user interface described below, a user can individually or separately adjust the elevation H, angular orientation θ, profile, and foot section extension position F. That is, each adjustment can be made without affecting any of the other adjustments and, with only limited exceptions, the ability to make an adjustment is not a function of the state of adjustment of the other features. One of these exceptions is that the maximum achievable angular orientation θ may be a function of bed elevation. Specifically, the ability to achieve the maximum angular orientation can be limited if the bed is at a low elevation; additional adjustment toward the full angular orientation may be achievable only after the elevation is increased.

If the mattress is an adjustable firmness mattress, the adjustable settings include the firmness of the mattress. The adjustable settings typically include a "normal" firmness mode, which inflates the mattress according to the weight in the bed and the positions of the deck sections, and a "max inflate" mode which inflates the bed to a maximum setting. If the mattress is an adjustable firmness mattress, the adjustment system includes the compressor and/or aspirator unit 62.

Figure 6:
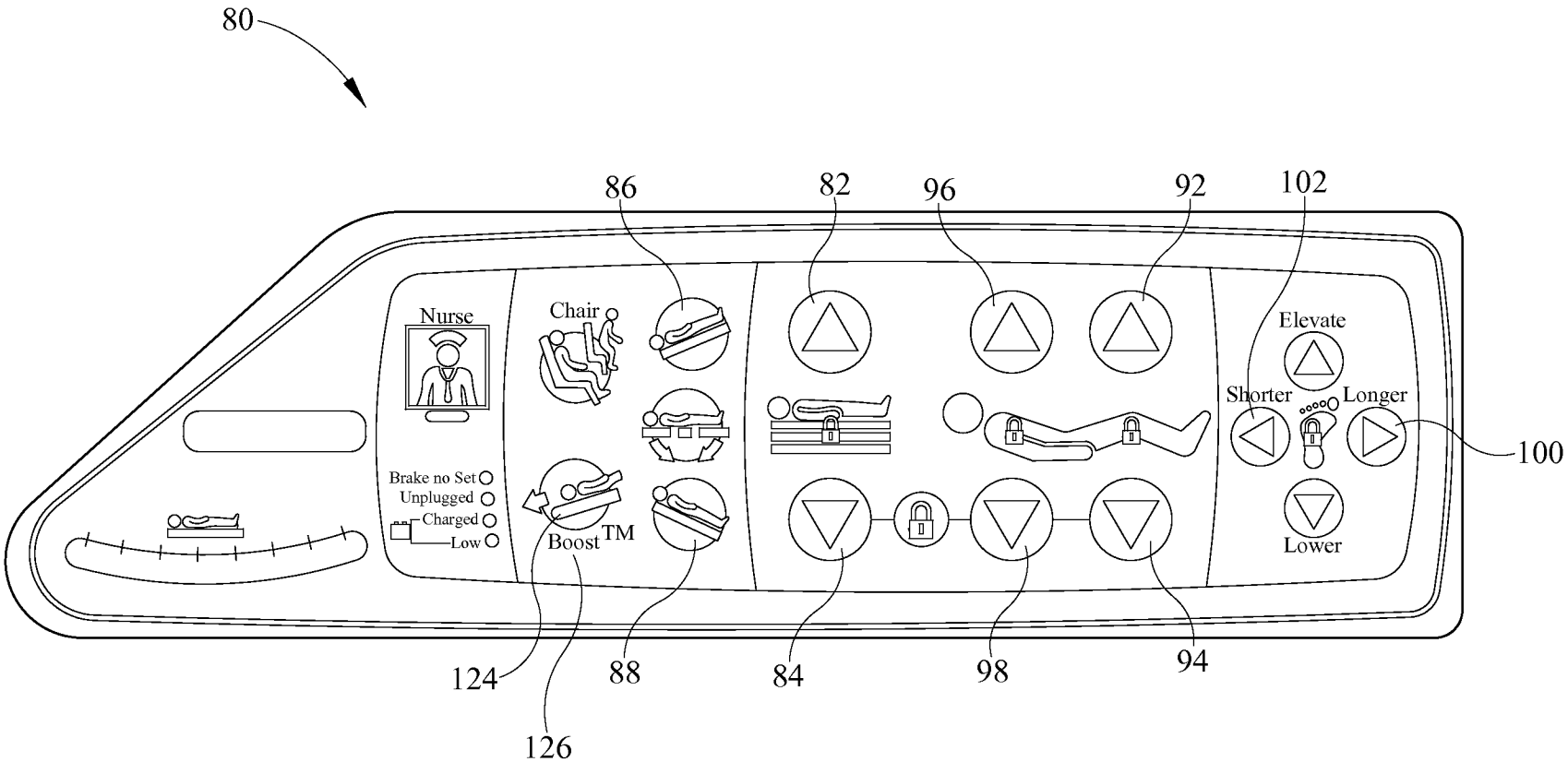
FIG. 6 is a view of a user interface with keys for individually adjusting elevation, profile and angular orientation of the bed to desired settings thereof.

Referring additionally to FIG. 6, the bed also includes one or more user interfaces such as the interface 80 on siderail 54. Other user interfaces may also be present on the siderails or on other parts of the bed. The user interface shown in FIG. 6 allows a user to individually command desired values of the adjustable settings of the occupant support. Keys 82, 84 adjust the elevation H of the occupant support. Keys 86, 88 adjust the angular orientation θ. Keys 92, 94 adjust the profile by pivoting the thigh and calf sections 42, 44; keys 96, 98 adjust the profile by pivoting the deck upper body section 40. Keys 100, 102 adjust the position F of the foot section extension.

Figure 7:
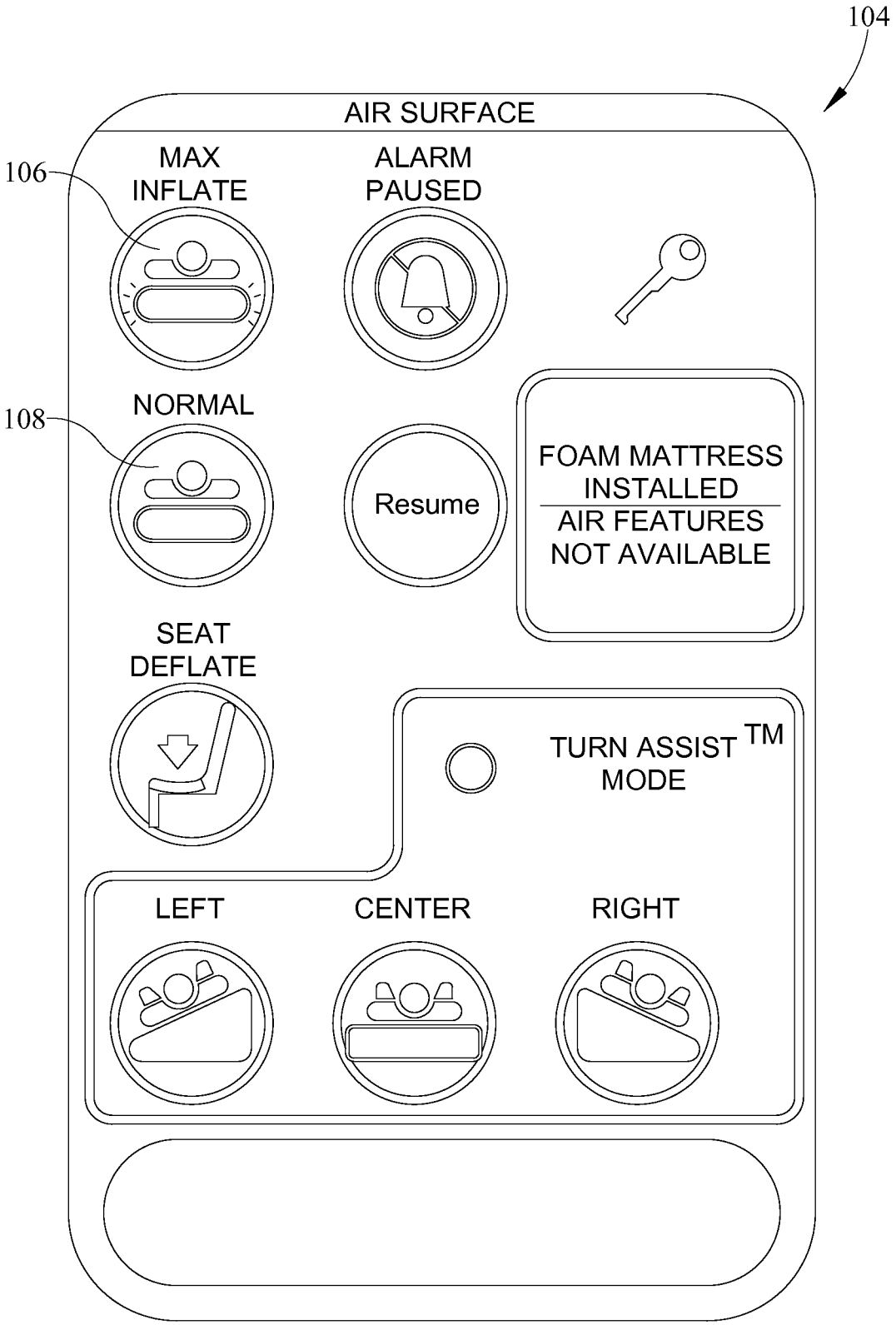
FIG. 7 is a view of another user interface with keys for individually adjusting the firmness of a mattress deployed on the bed.

FIG. 7 shows a separate user interface 104 for commanding inflation of an inflatable mattress. Keys 106, 108 are used to place the mattress in a "normal" or "maximum inflate" condition.

Although the interfaces 80, 104 are depicted as keypads with keys, other types of interfaces such as foot pedals may also be used.

A controller 120 (FIG. 5), such as a microprocessor, receives the user's commands from the user interface(s) and controls operation of the actuators to effect the commanded adjustments.

Using the above described keys a user can exercise individual control over the adjustable settings of the occupant support. For example the user can use the elevation keys 82, 84 to adjust the elevation H without affecting the angular orientation θ or can use the angular orientation keys 86, 88 to adjust the angular orientation without affecting mattress firmness, and so forth.

The bed also includes a single-action boost control 124 in the form of a key 126 on user interface 80. Although the boost control 124 is shown as a key, the boost control may take other physical forms. The boost control, when pressed by a user, issues a command to the controller to place the occupant support in a boost configuration defined by two or more settings. The boost configuration settings are settings that facilitate repositioning of a bed occupant toward the head end of the bed. The boost control is referred to as a single action control because a single action, such as a user applying pressure on the key 126, affects all the adjustments defined by the boost configuration.

Figure 4:
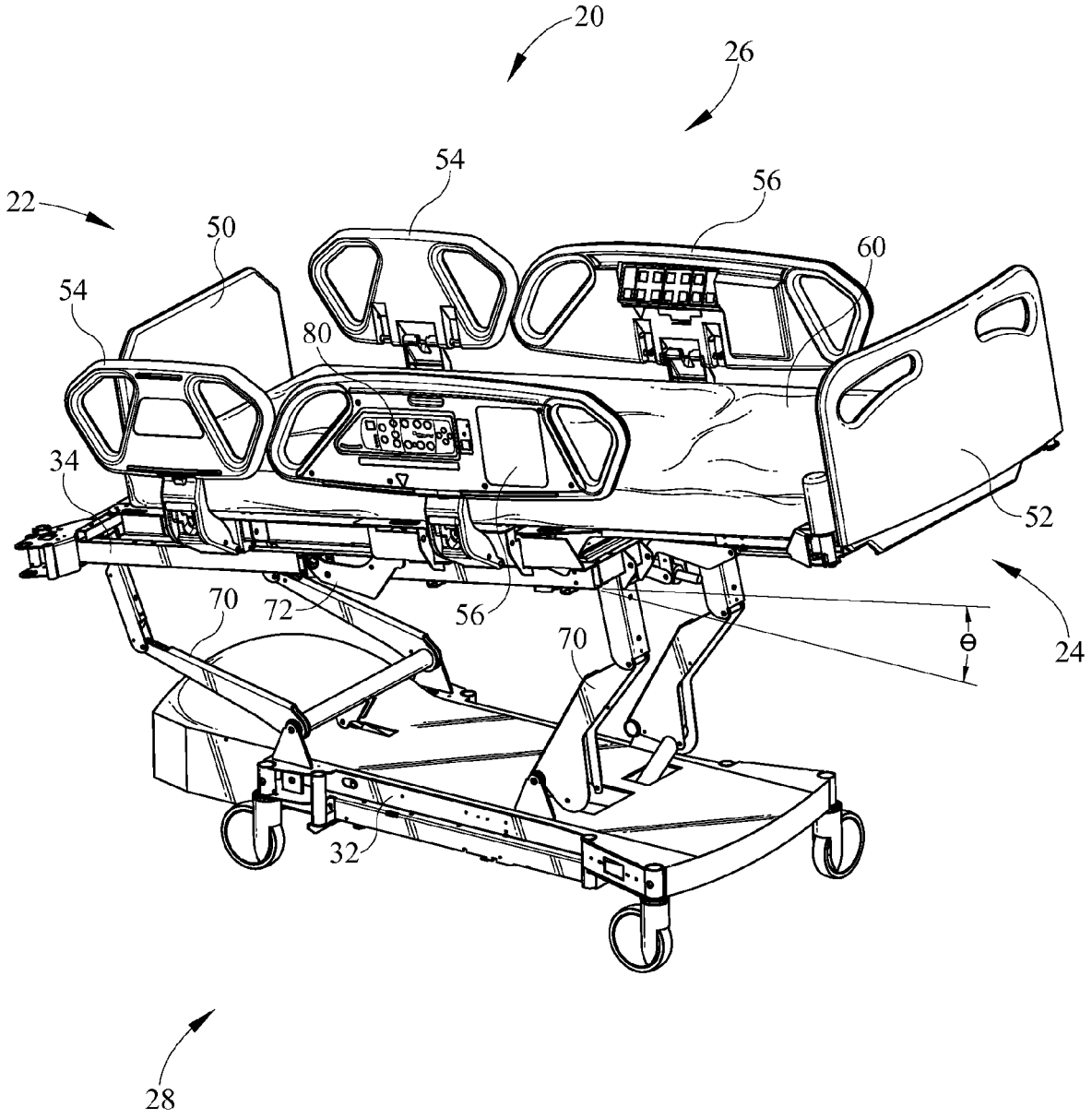
Figure 5:
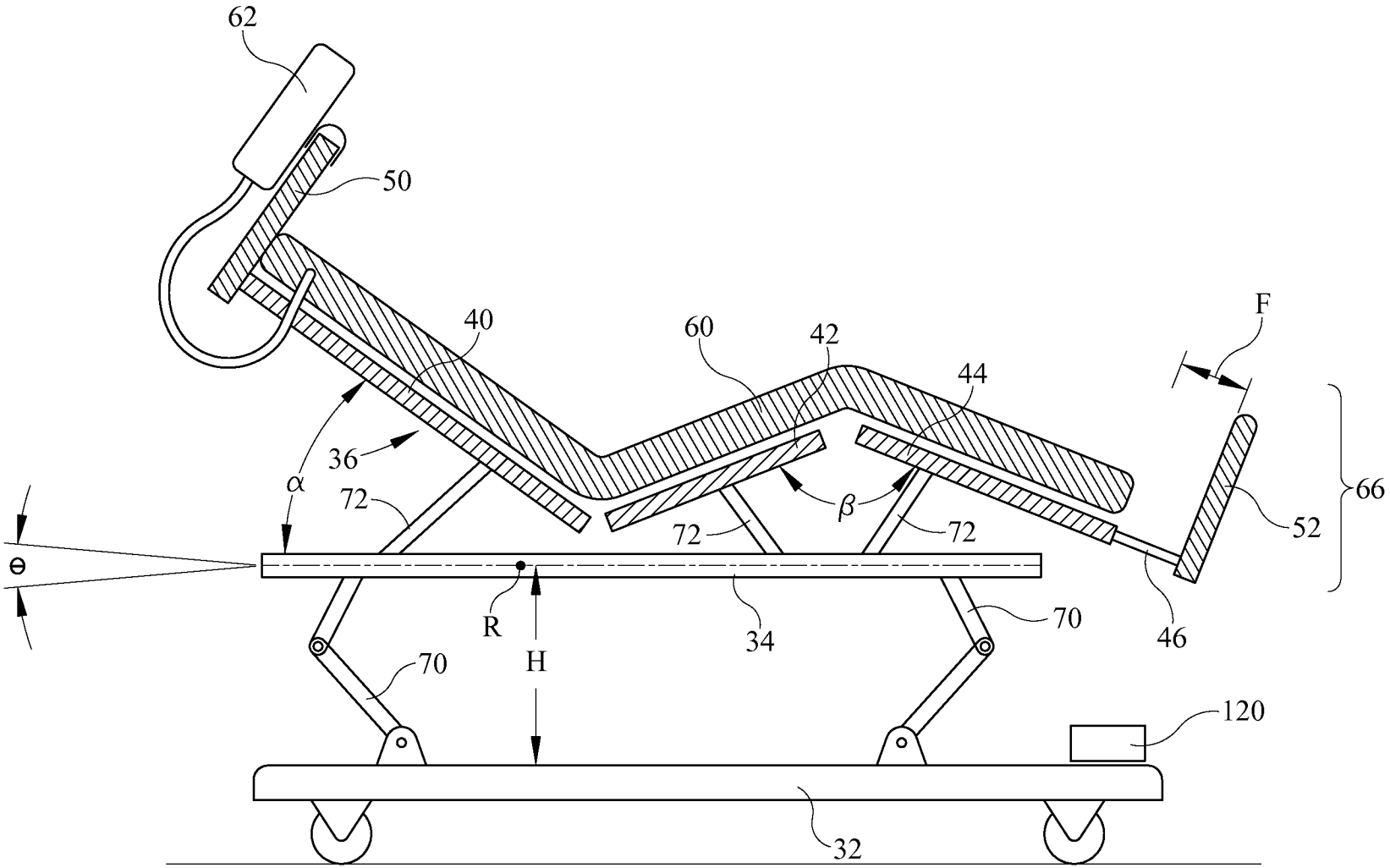
FIG. 5 is a schematic side elevation view of the bed.

The boost configuration is defined by at least a boost elevation setting and a boost profile setting. The boost elevation setting may or may not depend on the initial elevation of the bed as described in more detail below. Preferably, the boost elevation setting is a pre-established working height satisfactory to a large proportion of the caregiver population. The preferred boost profile setting is a flat profile, i.e. a profile in which angles α and β are both approximately zero. Preferably the boost configuration is also defined by a boost angular orientation setting θ (FIGS. 4, 5). The preferred boost angular orientation setting is about seven degrees head down relative to the orientation of the base frame 32. If the bed is equipped with an adjustable firmness mattress, the boost configuration may also include a boost firmness setting instead of or, more preferably, in addition to a boost angular orientation setting. The boost firmness setting is a firmness substantially equal to the maximum firmness, or at least closer to the maximum firmness than to the normal firmness. If the bed is equipped with a position adjustable foot section extension 46, the boost configuration includes a boost position setting of the foot section extension. In one variant of the bed the boost position setting of the extension is its existing position at the time the user applies pressure to the boost control. In another variant the boost position setting of the extension is its fully retracted position. The fully retracted position, because it is as close as possible to the bed occupant, may allow the occupant to assist in his own repositioning by pushing against the footboard 52 with his feet.

Figure 8A:
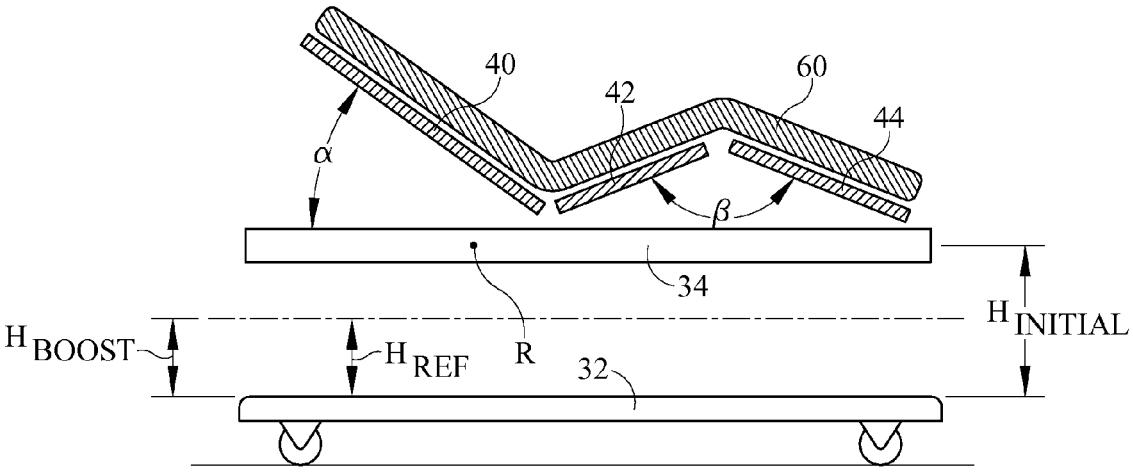
FIGS. 8A-8C are a sequence of schematic side elevation views showing adjustment of the bed elevation, profile and angular orientation.
Figure 8B:
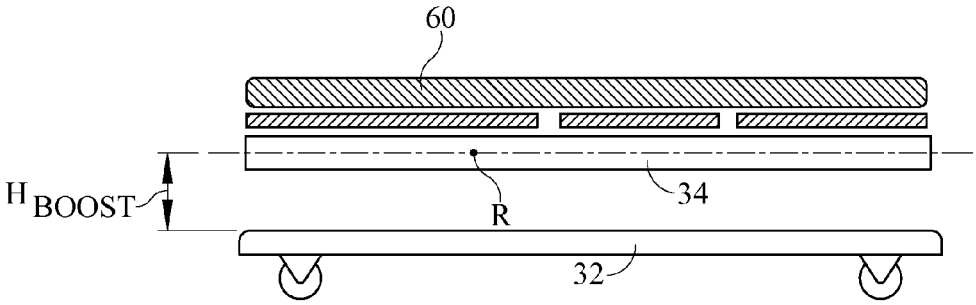

FIGS. 6 and 8-9 show a response to a user's application of pressure to the boost control 126. The occupant support begins moving from its initial elevation $H_{INITIAL}$ to a boost elevation setting $H_{BOOST}$. As described in more detail below, the boost elevation setting may depend on the initial elevation $H_{INITIAL}$ or may be independent of the initial elevation. The adjustment system also begins moving the occupant support from its initial profile to the boost profile, e.g. to the flat profile described above. The elevation and profile adjustments may occur sequentially or may occur at least partially concurrently as seen in FIGS. 9A and 9B. The elevation adjustment ceases when the elevation reaches the boost elevation setting. The profile adjustment ceases when the deck 36 reaches the boost profile setting. The elevation and profile adjustments also cease if the user does not sustain pressure on the boost control, and resume if the user re-applies pressure. FIGS. 9A and 9B show the boost elevation and the boost profile being achieved at the same time, but this need not be the case.

Figure 9A:
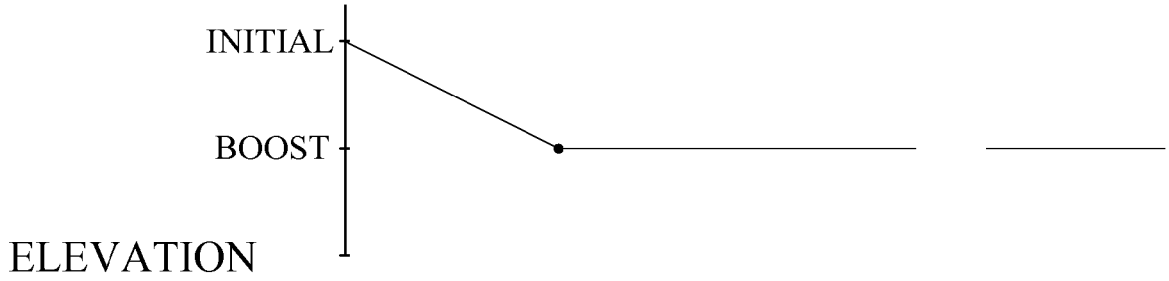
FIGS. 9A-9D are graphical depictions showing adjustment of the bed elevation, profile, angular orientation and firmness.
Figure 9B:
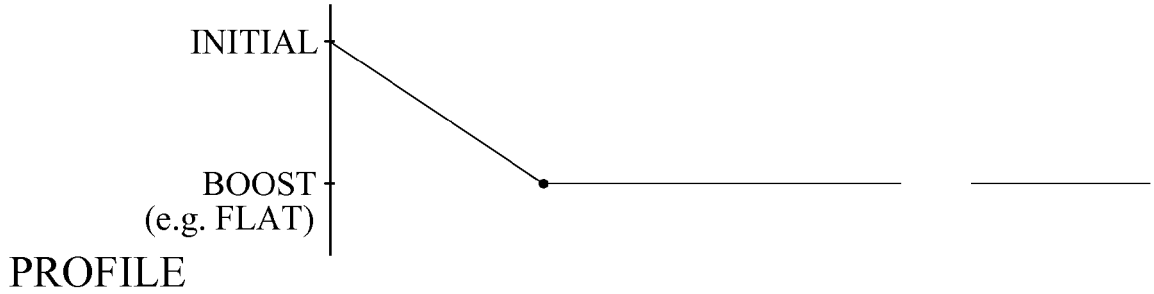
Figure 9C:
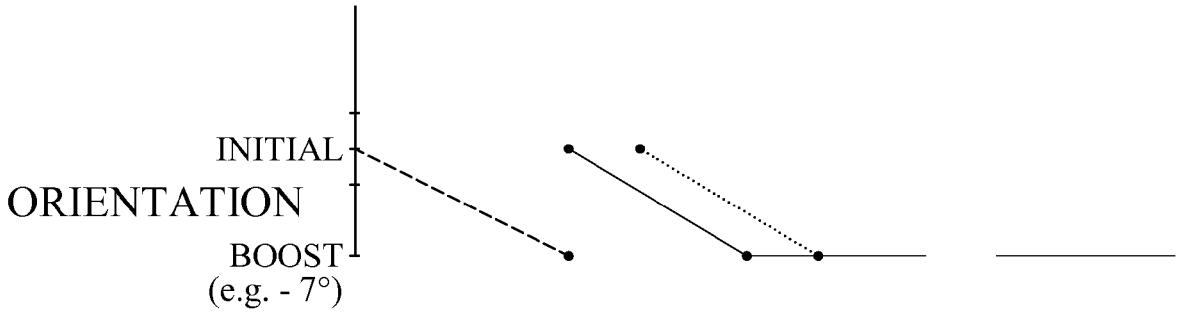
Figure 9D:
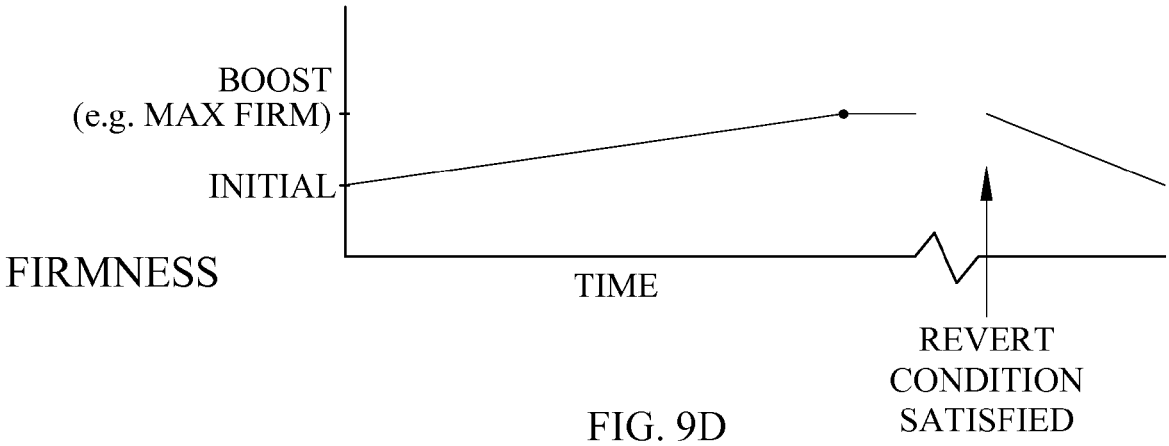

If the bed is equipped with an adjustable firmness mattress, and the boost configuration includes a boost firmness setting, the pressure initially exerted by the user on the boost control 126 also causes the compressor 62 to begin inflating the mattress to its boost firmness setting as seen in FIG. 9D. The compressor will continue to inflate the mattress to the boost firmness setting even if the user releases pressure on the boost control. The mattress will revert to its pre-existing (pre-boost) firmness after a revert condition has been satisfied. The revert condition is considered to have been satisfied after the lapse of an interval of time, for example 30 minutes after pressure was first applied to the boost control 124. The revert condition may also be considered to have been satisfied if the user, after having pressed and released the boost control, commands a bed adjustment other than the boost feature.

Figure 8C:
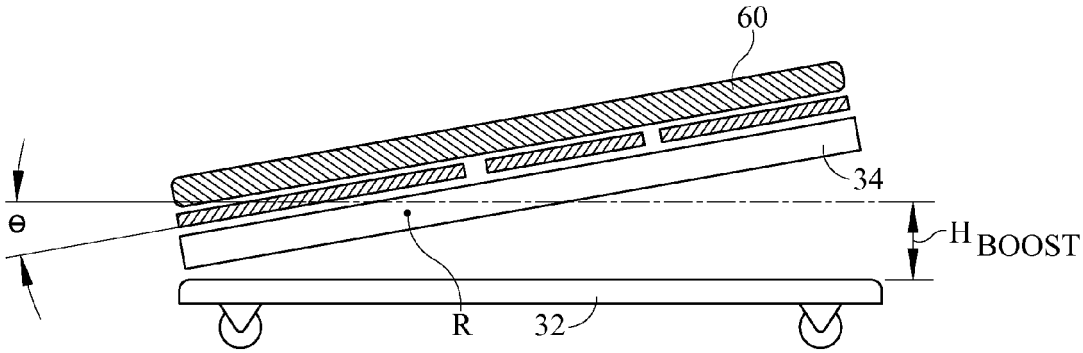

As already noted, and as seen in FIG. 8C, the boost configuration may also include a boost angular orientation setting θ, preferably a seven degree head down setting, in addition to the boost elevation setting, the boost profile setting and the boost firmness setting (if applicable). The angular orientation adjustment may occur concurrently or at least partly concurrently with the elevation and profile adjustments (FIG. 9C, dashed line). Alternatively, the angular orientation adjustment can be deferred until after the elevation and profile adjustments are complete. The angular orientation adjustment, if deferred, may commence substantially immediately after attainment of the predefined elevation and profile (FIG. 9C, solid line) or may be additionally delayed for an interval of time, for example about one second (FIG. 9C, dotted line). During the additional delay, the user is required to maintain pressure on the boost key, otherwise the angular adjustment will not occur. Deferring the angular orientation adjustment allows the user to release the boost control to take advantage of the elevation, profile and firmness adjustments (if applicable) but to prevent any adjustment to the angular orientation. This capability is useful in situations where it may not be advisable to place the occupant in a head-down orientation. The angular orientation adjustment ceases when the angular orientation reaches the boost angular orientation setting or when the user no longer sustains pressure on the boost control 126.

In view of the foregoing, certain specific embodiments and enhancements may now be better appreciated.

Figure 10A:
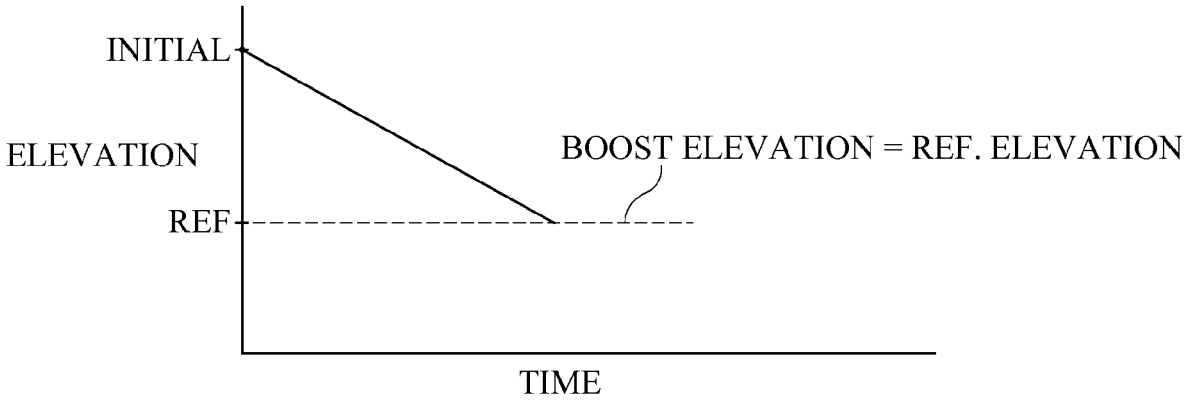
FIGS. 10A-10B are graphical depictions showing a boost elevation as a function of initial elevation of the bed.
Figure 10B:
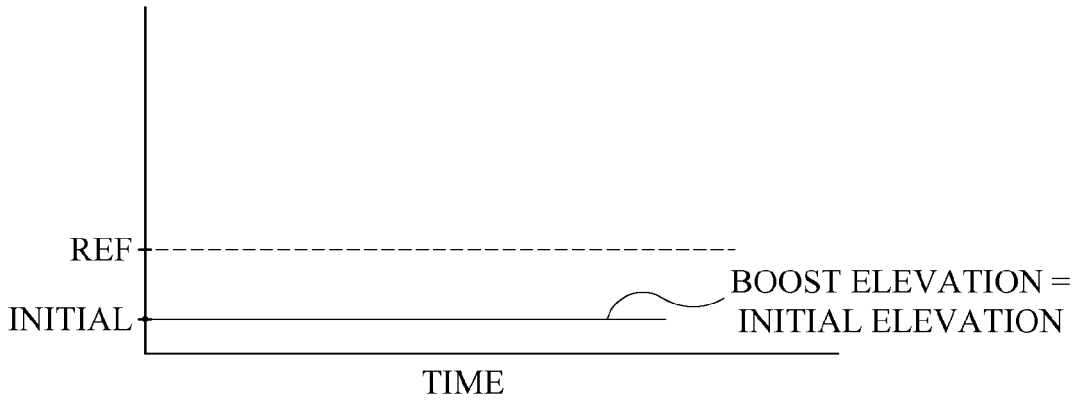

Referring to FIG. 10, in one specific embodiment, the boost elevation setting depends on the initial elevation $H_{INITIAL}$ of the occupant support relative to a reference elevation $H_{REF}$. In the disclosed embodiments $H_{REF}$ is about 6 inches (about 15.25 cm) higher than the lowest elevation to which the intermediate frame 34 can be lowered. If the initial elevation of the occupant support is higher than the reference elevation $H_{REF}$, the boost elevation setting equals the reference elevation. As a result, the response to a user input to the boost control will include a lowering of the occupant support as seen in FIG. 10A (and in FIG. 8B). However if the initial elevation of the occupant support is lower than the reference elevation (FIG. 10B), the boost elevation setting equals the initial elevation. As a result the response to the user input will not include a raising of the occupant support. Instead the adjustment system will adjust the occupant support profile to the boost profile setting, adjust the angular orientation to the boost angular orientation setting and, if applicable, adjust the mattress firmness to the boost firmness setting.

Figure 11A:
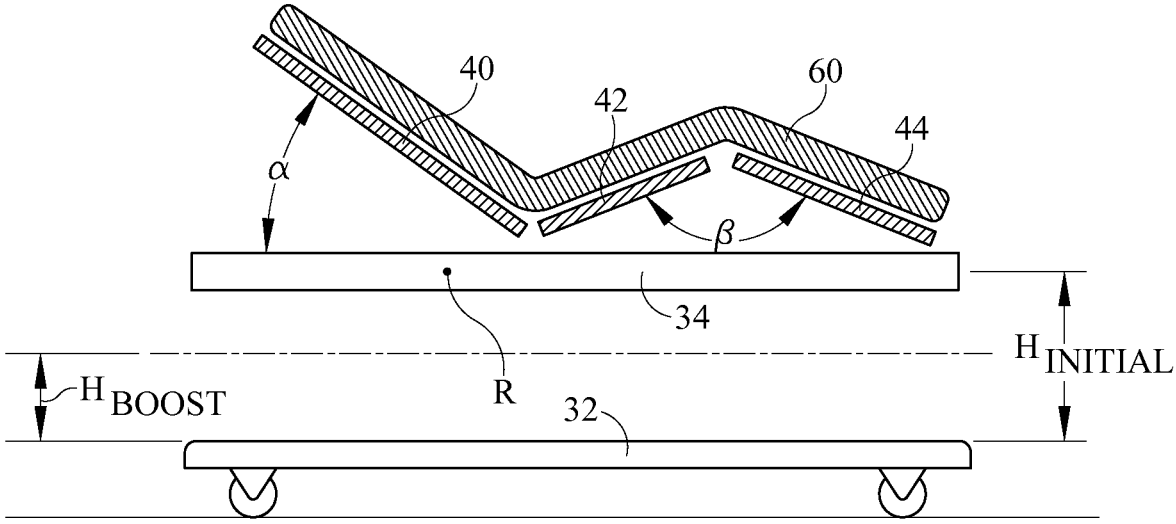
FIGS. 11A-11D are a sequence of views similar to those of FIG. 8 showing why it may be desirable for the boost elevation to depend on the initial elevation of the bed.
Figure 11B:
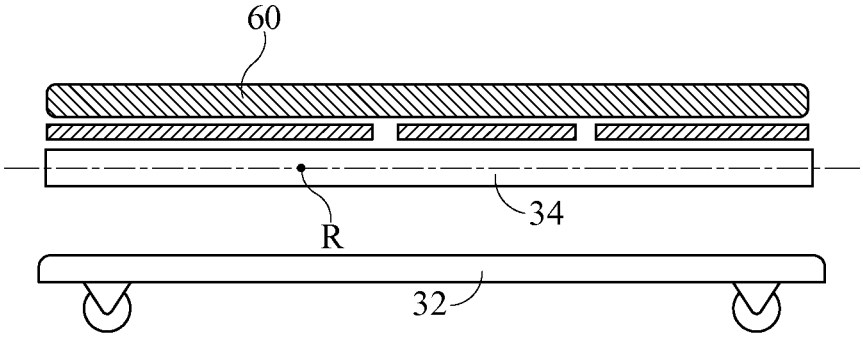
Figure 11C:
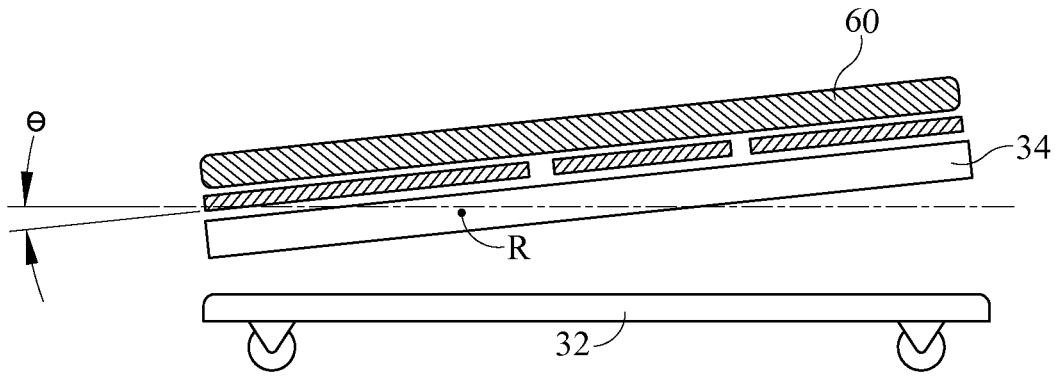
Figure 11D:
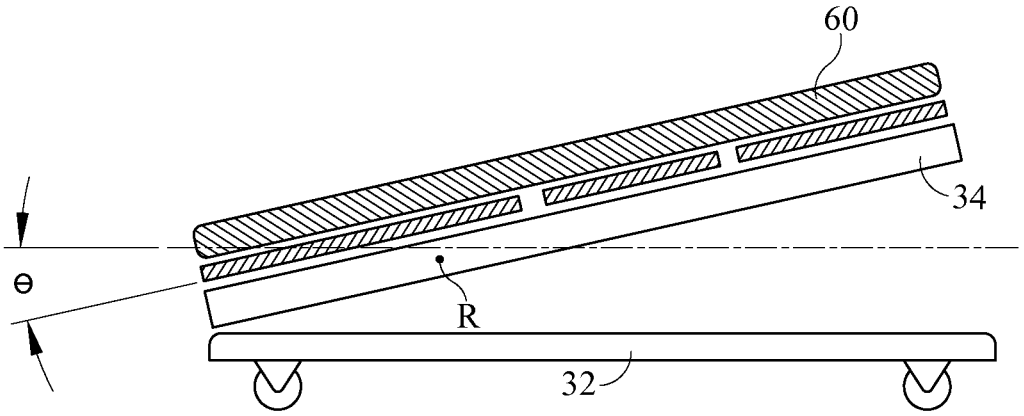

The above described dependence of the boost elevation on the initial elevation may be desirable to prevent certain innocuous but extraneous movements of the occupant support that might otherwise occur when the initial elevation of the occupant surface is above a boost elevation that does not depend on initial elevation. Referring to FIGS. 11A-11D, consider a bed configured to lower the occupant support to the boost elevation $H_{BOOST}$ if the initial position of the occupant support is above the boost elevation and to raise the occupant support to the same boost elevation if the initial position of the occupant support is lower than the boost elevation. The bed is in an initial state A (FIG. 11A). As described above, application of pressure to the boost control adjusts the elevation and profile to achieve state B (FIG. 11B) and then begins to adjust the angular orientation toward state D (FIG. 11D). The change of angular orientation can cause elevation reference datum R, which is about one third of the distance from the head end to the foot end of the intermediate frame, to drop below the boost elevation $H_{BOOST}$ as depicted at intermediate state C (FIG. 11C). If the user releases pressure on the boost control when the bed is at state C, and then reapplies pressure to the control, the controller 120 would interpret state C as the initial, pre-boost state of the bed. Because the controller perceives datum R as being lower than the boost elevation, the control system would respond by raising the occupant support until datum R arrives at the boost elevation, and by adjusting the angular orientation to a level orientation. The control system would then command an angular orientation adjustment toward state D. Because the control system previously commanded a head down angular orientation and also commanded reference datum R to drop below the boost elevation (due to the combination of a decrease in elevation to the boost elevation followed by a change in angular orientation) the re-elevation and re-leveling may be viewed as an extraneous or wasted motion. This extraneous motion can be avoided by making the boost elevation a function of initial elevation as described in the previous paragraph. Irrespective of whether the boost elevation depends on or is independent of the initial elevation, extraneous motion may also be avoided by including appropriate instructions in the controller software, albeit with an attendant increase in software complexity and/or memory requirements. Accordingly, another specific embodiment has a boost elevation that is independent of initial elevation.

Figure 12A:
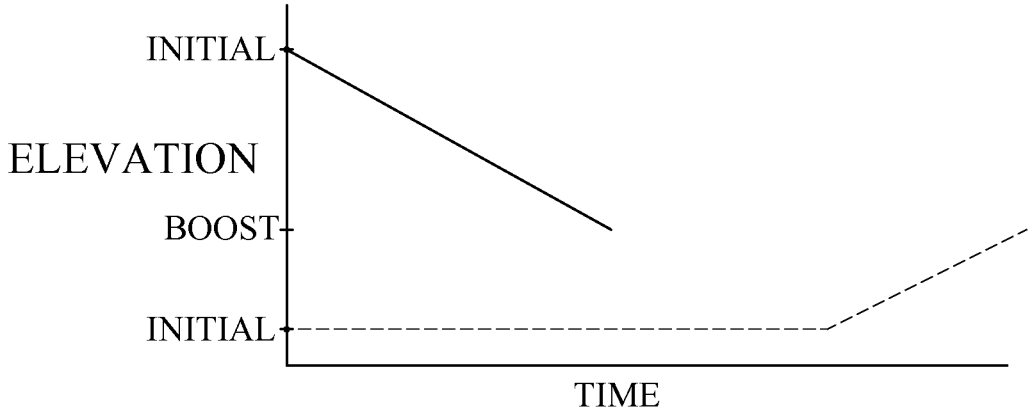
FIGS. 12A-12C are a sequence of views comparing an embodiment in which the elevation is adjusted at least partly concurrently with a profile adjustment to an embodiment in which the elevation adjustment is deferred until after the completion of the profile and angular orientation adjustments.
Figure 12B:
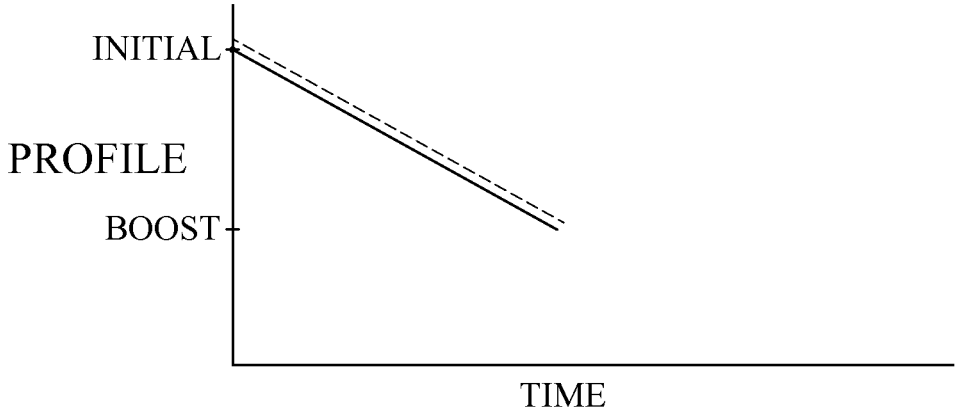
Figure 12C:
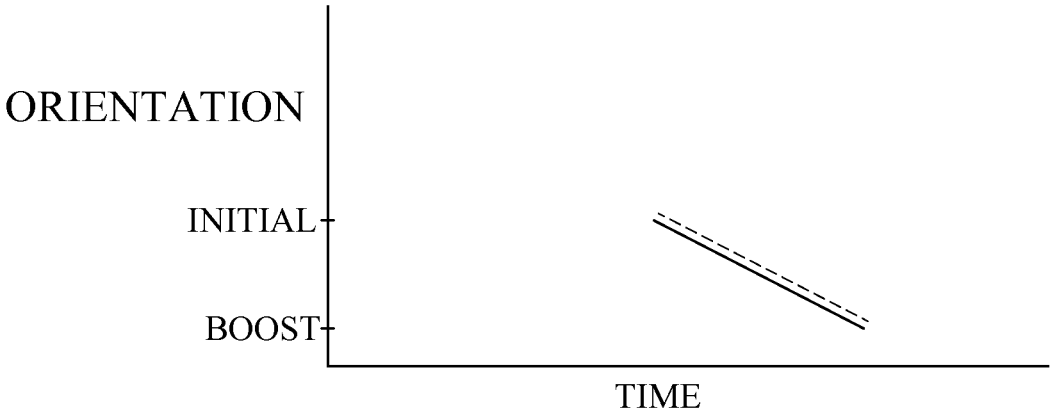

Referring to FIG. 12, the adjustment system adjusts the occupant support elevation H to a boost elevation independently of the initial elevation. As described above, if the initial elevation is higher than the boost elevation, the change in angular orientation is deferred until after the elevation and profile achieve the boost elevation and boost profile (solid lines). However if the initial elevation is lower than the boost elevation (dashed lines) the occupant support is adjusted to the boost elevation only after the bed profile and angular orientation are adjusted to the boost profile and boost orientation (dashed lines).

As already noted, adjustments may occur concurrently or sequentially. In another specific embodiment, the elevation, profile and angular orientation adjustments are carried out sequentially in the order just listed, independent of the initial elevation of the occupant support, provided the user sustains pressure on the boost control.

Figure 13:
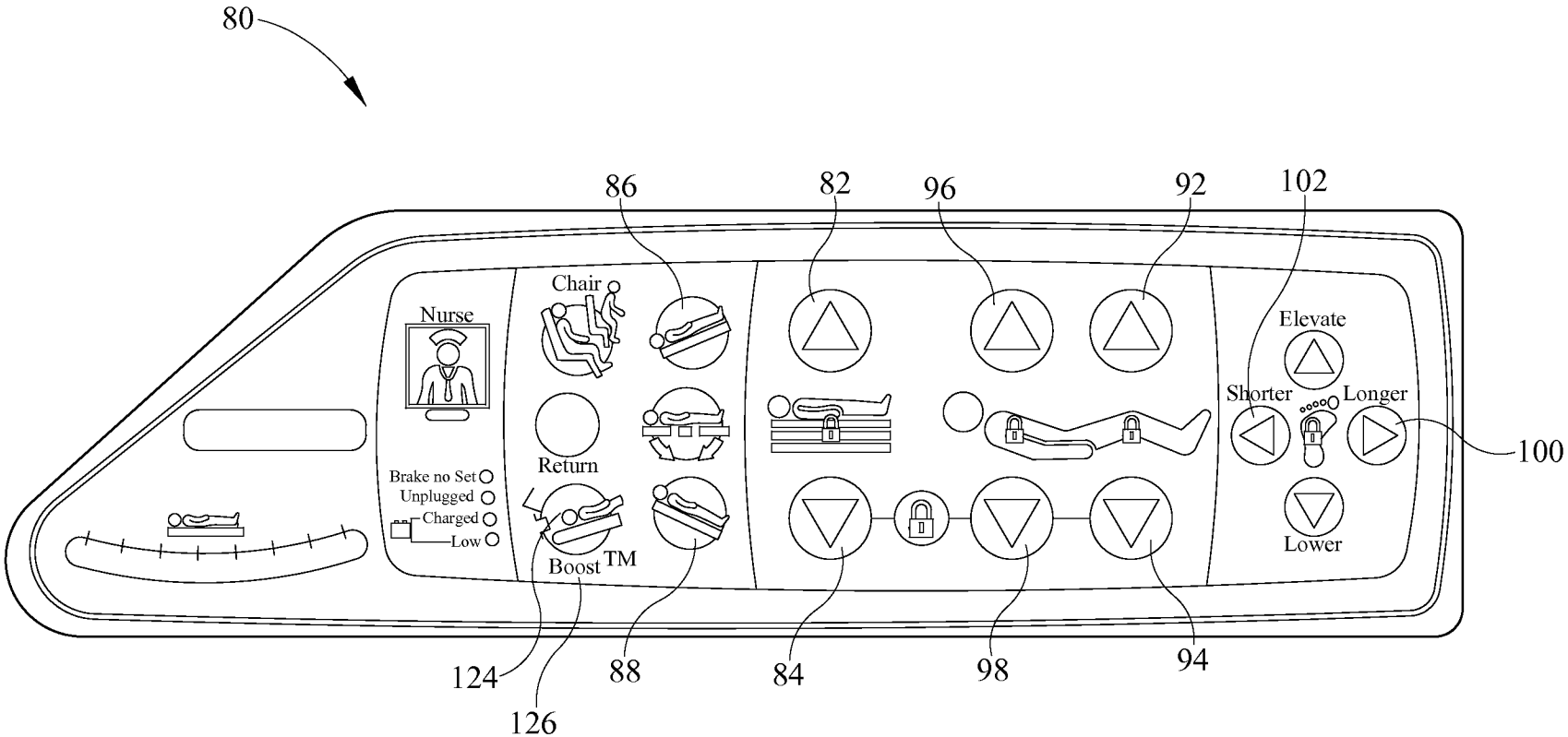
FIG. 13 is a view similar to FIG. 6 showing a "RETURN" key.

As seen in FIG. 13, a single action "RETURN" key 128 may be provided to return the occupant support to whatever state it had been in prior to activation of the boost function.

Although this disclosure refers to specific embodiments, it will be understood by those skilled in the art that various changes in form and detail may be made without departing from the subject matter set forth in the accompanying claims.

We claim:

1. An adjustable bed, comprising:

an occupant support having adjustable settings that include an elevation, a profile and an angular orientation;

an interface for allowing desired values of the adjustable settings to be individually commanded;

a single-action boost control for commanding a boost configuration comprising a boost elevation setting, a boost profile setting and a boost angular orientation setting; and an adjustment system for adjusting the adjustable settings to the desired values in response to inputs to the interface and for adjusting the elevation, profile and angular orientation to the boost configuration settings in response to input applied to the single-action boost control.

2. The bed of claim 1 wherein the elevation and profile are adjusted to the boost elevation setting and the boost profile setting at least partially concurrently.

3. The bed of claim 1 wherein the boost elevation setting is independent of an initial elevation of the occupant support.

4. The bed of claim 1 wherein the boost elevation setting depends on an initial elevation of the occupant support.

5. The bed of claim 4 wherein:

if an initial elevation of the occupant support is higher than a reference elevation, the boost elevation setting equals the reference elevation; and if the initial elevation of the occupant support is lower than the reference elevation, the boost elevation setting equals the initial elevation.

6. The bed of claim 1 wherein:

the boost elevation setting is a pre-established working height; and the boost profile is substantially flat.

7. The bed of claim 6 wherein the boost angular orientation setting is approximately seven degrees head down.

8. The bed of claim 1 wherein the adjustment system adjusts the elevation, the profile and the angular orientation in response to a sustained user input applied to the single-action boost control with adjustment of the angular orientation deferred until after the elevation and profile are substantially at the boost elevation setting and boost profile setting.

9. The bed of claim 1 wherein the adjustment system adjusts the elevation, the profile and the angular orientation in response to a sustained user input applied to the single-action boost control with adjustment of the elevation deferred until after the angular orientation and the profile are substantially at the boost angular orientation setting and the boost profile setting.

10. The bed of claim 1 wherein:

the adjustable settings include a mattress firmness adjustable to a normal firmness and a maximum firmness; and the boost configuration includes a boost firmness, the boost firmness being closer to the maximum firmness than to the normal firmness.

11. The bed of claim 10 wherein the adjustment system adjusts the elevation, profile and angular orientation in response to a sustained user input applied to the single action boost control and adjusts the firmness in response to a non-sustained input applied to the single action boost control.

12. The bed of claim 10 wherein the boost firmness is substantially equal to the maximum working firmness.

13. The bed of claim 10 wherein the mattress firmness reverts from the boost firmness to a pre-existing firmness in response to a revert condition having been satisfied.

14. The bed of claim 13 wherein the revert condition comprises exceedance of a time limit.

15. The bed of claim 13 wherein the revert condition comprises a user input to command an adjustment other than adjustment to the boost configuration.

16. The bed of claim 1 comprising:

a foot section extension positionable at a position between a fully extended position and a fully retracted position; and the boost configuration includes a boost position setting of the foot section extension.

17. The bed of claim 16 wherein the boost position setting of the foot section extension is its existing position at the time a user applies pressure to the boost control.

18. The bed of claim 16 wherein the boost position setting of the foot section extension is its fully retracted position.

19. The bed of claim 1 including a RETURN control for returning the bed to a configuration existing prior to its response to the input applied to the single-action boost control.

20. The bed of claim 1 wherein:

the adjustable settings include an optional mattress firmness adjustable between a normal firmness and a maximum firmness;

the boost configuration includes a boost firmness setting substantially equal to a maximum firmness;

the adjustment system adjusts the elevation, the profile and the angular orientation to the boost configuration in response to a sustained user input applied to the single-action boost control; and the adjustment system also adjusts the firmness to a setting substantially equal to the boost setting firmness in response to a non-sustained input applied to the single action boost control.

* * * * *